United States Patent [19]

Hoben

[11] 4,122,565

[45] Oct. 31, 1978

[54] MATTRESS ASSEMBLY TO ACCOMMODATE A BEDPAN

[76] Inventor: Blanche E. Hoben, 1748 Evergreen, Walla Walla, Wash. 99362

[21] Appl. No.: 848,117

[22] Filed: Nov. 3, 1977

[51] Int. Cl.[2] ..... A61G 7/02

[52] U.S. Cl. ..... 5/90; 4/112; 5/91

[58] Field of Search ..... 5/90, 91; 312/111, 319, 312/330, 333; 248/206 A; 4/112; 292/251.5

[56] References Cited

U.S. PATENT DOCUMENTS

| | | | |
|---|---|---|---|
| 2,932,831 | 4/1960 | Keathley, Sr. et al. | 5/90 |
| 3,833,945 | 9/1974 | Moody | 5/91 |
| 4,011,610 | 3/1977 | Parker | 5/90 |
| 4,047,773 | 9/1977 | Semany | 248/206 A |

FOREIGN PATENT DOCUMENTS

| | | | |
|---|---|---|---|
| 724,310 | 2/1955 | United Kingdom | 5/90 |

*Primary Examiner*—Casmir A. Nunberg
*Attorney, Agent, or Firm*—Wells, St. John & Roberts

[57] ABSTRACT

A mattress assembly for accommodating a bedpan is described to enable a patient to dispose of his human wastes without leaving his bed. A cavity is formed in the mattress for receiving a slidable insert. The insert is held in the cavity by permanent magnets. The sides of the insert are contoured to form curved ridges that slide in corresponding grooves formed in the walls of the cavity.

5 Claims, 5 Drawing Figures

MATTRESS ASSEMBLY TO ACCOMMODATE A BEDPAN

BACKGROUND OF THE INVENTION

The present invention relates to mattress assemblies and more particularly to such assemblies that include recesses for releasably receiving bedpans.

The common way for a bedridden person to discharge body wastes is through use of a "bed pan" which is a low profile, somewhat open pan. The difficulty in using such pans is that the patient must first elevate himself or otherwise roll onto the bedpan which is necessarily above the elevation of the mattress.

Another problem is that bedpans are notorious for slipping on mattress sheets. It may go without mention that this can cause humiliating and very uncomfortable circumstances.

It therefore becomes very desirable for the convenience of the attendant and, more importantly, the relief and security of a bedridden patient especially that some form of apparatus be developed that will lower the elevation of the pan and, at the same time, keep it from undesired sliding.

BRIEF DESCRIPTION OF THE DRAWINGS

A preferred form of the present invention is illustrated in the accompanying drawings, in which.

DETAILED DESCRIPTION OF A PREFERRED EMBODIMENT

Figure 1:
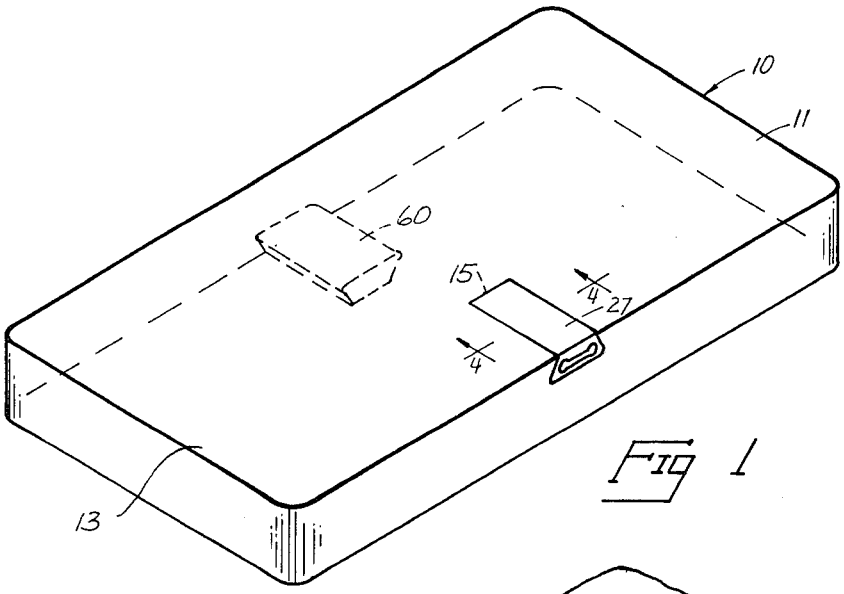
FIG. 1 is a pictorial view of the present mattress assembly.
Figure 2:
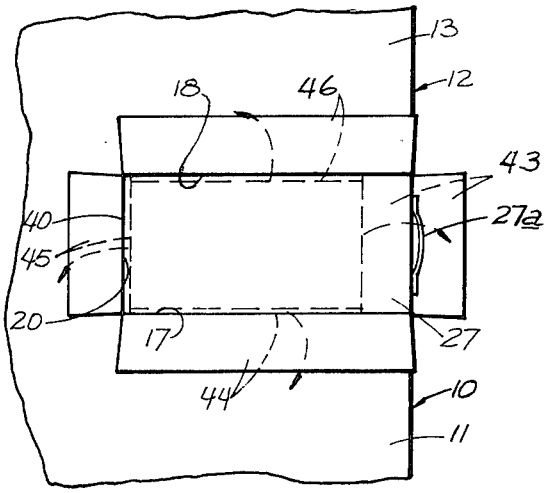
FIG. 2 is a fragmentary plan view showing the cavity and flaps of the sheet folded away therefrom.
Figure 3:
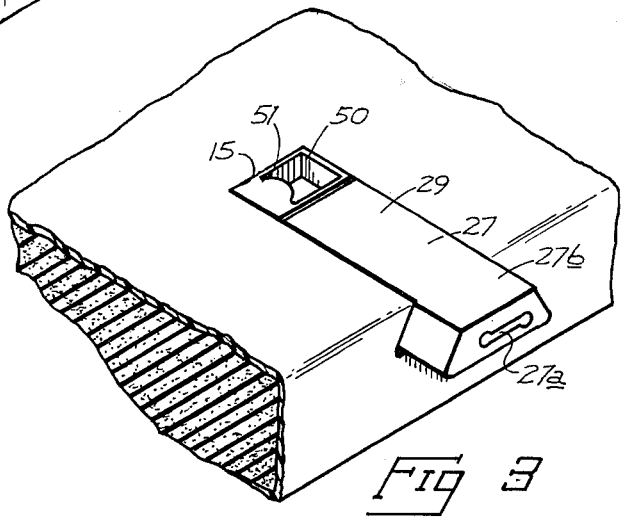
FIG. 3 is a fragmentary perspective view showing the insert partially removed to accommodate the bedpan.
Figure 5:
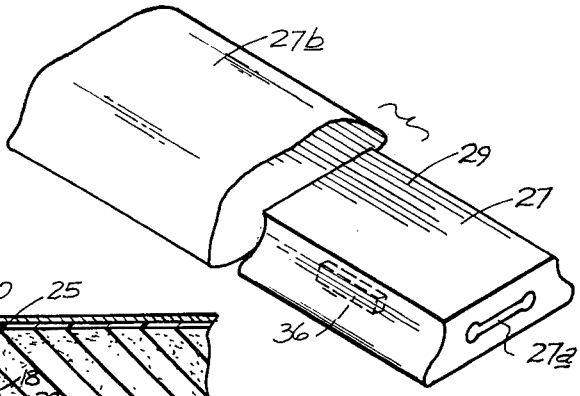
FIG. 5 is a pictorial view of the present insert for the cavity.
Figure 4:
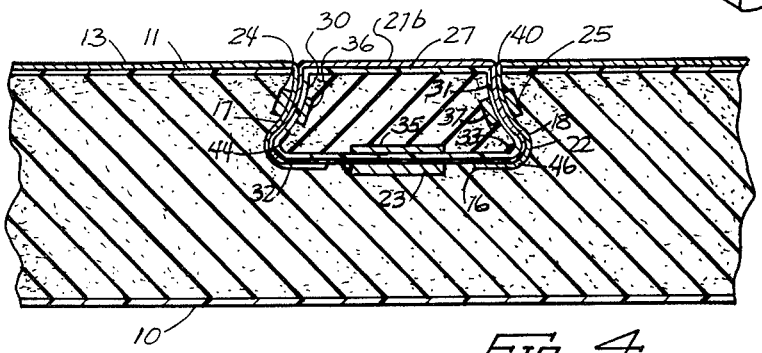
FIG. 4 is a cross-sectional view taken along line 4—4 in FIG. 1.

FIG. 1 illustrates a mattress assembly that includes a rectangular mattress 10 having a top surface 11 and a side surface 12. A fitted sheet 13 is mounted on the mattress enclosing the top, side and end surfaces of the mattress 10. The mattress 10 may be constructed of rubber or plastic foam or of other conventional material.

A cavity or slot 15 is formed in the top surface 11 and the side 12 to a depth less than the thickness of the mattress. The cavity has a prescribed cross section. The slot 15 has a bottom wall 16 that is substantially parallel with the top surface 11 and contoured side walls 17 and 18 that are contoured into the mattress. The cavity also has an end wall 20. The cavity 15 is substantially elongated and extends from the central portion of the mattress to the side surface 12 parallel with the minor direction of the mattress. The contoured side walls 17 and 18 of the cavity are curved into the mattress to form curved grooves 21 and 22 respectively. A permanent magnet 23 is mounted in the bottom wall 16. The permanent magnets 24 and 25 are mounted in the side walls 17 and 18 respectively.

The mattress and sheet combination includes a mattress insert 27 that has a cross section equal to or slightly greater than the cross section of the cavity 15. The insert 27 is slidably mounted in the cavity to be moved from a closed position abutting the end wall 20 to an open position in which the mattress insert is slid outwardly to the side a sufficient distance to receive the bedpan 50 in the cavity. The mattress insert has a top surface 29 that is normally flush with the top surface 11 of the mattress. The insert 27 has contoured sides 30 and 31 respectively that are curved outwardly, forming ridges 32 and 33 respectively corresponding to the curvature of the grooves 21 and 22 so that the mattress insert may be slid horizontally outwardly to the side, but cannot be moved upwardly from the mattress. A handle **27*a*** is provided on the insert to facilitate this horizontal movement.

A permanent magnet 35 is mounted on the bottom of the mattress insert 27 for attracting the permanent magnet 23 when the insert is in the closed position to hold the insert firmly in the cavity. Permanent magnets 36 and 37 are mounted in the sides 30 and 31 respectively for coacting with the permanent magnets 24 and 25 respectively for assisting in preventing the insert from moving from the closed position when a patient moves about on the mattress.

The sheet 13 includes an opening 40, defined by foldable flaps 43 through 46 that may be made complimentary to the cavity 15. The flaps may be folded against appropriate adjacent sides of the cavity to keep the cavity open and allow access for the insert 27. In other words, the flaps will first be tucked in, then the insert will be put in place.

The insert is provided with its own case **27*b* (similar to a pillow case) that is constructed of the same material as the sheet 13. Thus, when the insert is in place the texture of sheet 13 will be continuous across the top surface 11**.

When a patient lying on the mattress needs to dispose of his waste, the mattress insert is slid outwardly a sufficient distance to insert a bedpan 50 into the cavity so that it is supported on the bottom wall 16. The insert 27 is then moved back to firmly grasp the bedpan between the insert and the end wall 18. The bedpan normally has a cup 51 that extends upwardly therefrom above the top surface 11 of the mattress to facilitate the reception of the waste.

Since the bedpan is secured between the end wall 20 and the end of the mattress insert 27 it is unlikely that the waste will be spilled.

If need be, the bottom wall 16, the end wall 20 and the side walls 17 and 18 of the cavity may be covered with a moisture resistant material.

After the patient has disposed of his waste into the bedpan the mattress insert 27 is moved outwardly slightly to release the bedpan. The bedpan is then removed and the mattress insert is pushed or slid back to its closed position with the permanent magnets securely holding the mattress insert.

To accommodate turning of the mattress an identical cavity and insert combination 60 is provided on the opposite side of the mattress as shown in FIG. 1.

It should be understood that the above described embodiment is simply illustrative of the principles of this invention and numerous modifications may be made without deviating from the scope thereof. Therefore, only the following claims are intended to define this invention.

What is claimed is:

1. A mattress assembly to accommodate a bedpan comprising:

a single unitary mattress having an upper patient support surface and a parallel bottom surface;

an elongated cavity of a prescribed cross section formed in the upper surface extending from the central area of the mattress to one side of the mattress for receiving the bedpan, said cavity having a bottom wall spaced upwardly of the bottom surface and substantially parallel with the top surface of the mattress for supporting the bedpan;

said cavity further including two countoured side walls;

a first permanent magnet mounted in the bottom wall of the cavity;

a mattress insert having a cross section equal to or slightly larger than that of the cavity;

said insert being slidably received in the cavity and having top and bottom surfaces and contoured sides for permitting horizontal sliding movement of the mattress insert in the cavity from a closed position totally filling the cavity and an open position to permit the placement of a bedpan in the cavity supported by the bottom wall with an upper rim of the bedpan being substantially flush with the upper surface of the mattress, and a second permanent magnet mounted on the bottom of the mattress insert for attracting the first permanent magnet to hold the mattress insert firmly in place when the mattress insert is in the closed position.

2. A mattress assembly as defined by claim 1 wherein the contoured side walls of the cavity diverge downwardly from the upper surface of the mattress to the bottom wall of the cavity to receive the complementary contoured sides of the mattress insert to prevent upward movement of the mattress insert relative to the mattress.

3. A mattress assembly as defined by claim 1 further comprising a mattress sheet having an opening complementary to the cavity; wherein the mattress sheet opening is elongated and extends over the cavity and down the side of the mattress below the mattress insert and wherein the mattress sheet has a plurality of flaps defining the opening that may be folded into the cavity between the cavity walls and the walls of the insert.

4. A mattress assembly as defined by claim 1 further comprising a case formed of sheet material for receiving the insert and covering the insert top surface.

5. A mattress assembly as defined by claim 1 wherein an additional cavity and mattress insert are included along the bottom surface of the mattress along a side opposite the one mattress side and that are substantially identical to the cavity and mattress insert provided along the upper surface of the mattress.

* * * * *